US011149684B2

(12) United States Patent
Dillard

(10) Patent No.: US 11,149,684 B2
(45) Date of Patent: Oct. 19, 2021

(54) METHOD FOR FABRICATING DILUTION HOLES IN CERAMIC MATRIX COMPOSITE COMBUSTOR PANELS

(71) Applicant: United Technologies Corporation, Farmington, CT (US)

(72) Inventor: Gary J. Dillard, Gainesville, FL (US)

(73) Assignee: Raytheon Technologies Corporation, Farmington, CT (US)

( * ) Notice: Subject to any disclaimer, the term of this patent is extended or adjusted under 35 U.S.C. 154(b) by 457 days.

(21) Appl. No.: 16/146,818

(22) Filed: Sep. 28, 2018

(65) Prior Publication Data

US 2020/0102907 A1 Apr. 2, 2020

(51) Int. Cl.

| | |
|---|---|
| ***F23R 3/06*** | (2006.01) |
| ***F02G 1/053*** | (2006.01) |
| ***C21B 7/06*** | (2006.01) |
| ***F27D 1/06*** | (2006.01) |
| ***F23R 3/00*** | (2006.01) |
| *B66B 9/06* | (2006.01) |
| *F02G 3/00* | (2006.01) |

(52) U.S. Cl.

CPC ..... *F02G 1/053* (2013.01); *C21B 7/06* (2013.01); *F23R 3/007* (2013.01); *F23R 3/06* (2013.01); *F27D 1/06* (2013.01); *B66B 9/06* (2013.01); *F02G 3/00* (2013.01)

(58) Field of Classification Search

CPC .... F23R 3/002; F23R 3/04; F23R 3/06; F23R 3/007; F23R 2900/00012

See application file for complete search history.

(56) References Cited

U.S. PATENT DOCUMENTS

| | | | | |
|---|---|---|---|---|
| 5,755,093 | A * | 5/1998 | Palusis | F02K 1/002 60/266 |
| 7,581,301 | B2 * | 9/2009 | Arbona | B62D 29/048 29/525.02 |
| 2004/0214051 | A1 | 10/2004 | Morrison et al. | |
| 2013/0255269 | A1 * | 10/2013 | McKenzie | F23R 3/06 60/772 |
| 2014/0318138 | A1 * | 10/2014 | Bunel | F23R 3/002 60/752 |
| 2016/0069567 | A1 | 3/2016 | Burd | |
| 2016/0186997 | A1 * | 6/2016 | Sadil | F23R 3/50 60/772 |
| 2016/0208704 | A1 | 7/2016 | Bouldin et al. | |
| 2016/0209033 | A1 | 7/2016 | Burd | |
| 2016/0334102 | A1 * | 11/2016 | Johnson | F23R 3/045 |
| 2016/0370007 | A1 * | 12/2016 | Hongoh | B22F 5/009 |
| 2017/0059159 | A1 | 3/2017 | Varney | |
| 2017/0138597 | A1 | 5/2017 | Freeman et al. | |
| 2019/0162412 | A1 * | 5/2019 | Bengtson | F23R 3/005 |

OTHER PUBLICATIONS

European Patent Office, European Search Report dated Jan. 28, 2020 in Application No. 19199305.4.

* cited by examiner

*Primary Examiner* — Gerald L Sung
*Assistant Examiner* — Rene D Ford
(74) *Attorney, Agent, or Firm* — Snell & Wilmer L.L.P.

(57) ABSTRACT

A heat shield panel for use in a combustor of a gas turbine engine is disclosed. In various embodiments, the heat shield panel includes an inner base layer, an outer base layer, and a grommet having a flange disposed between the inner base layer and the outer base layer.

16 Claims, 6 Drawing Sheets

METHOD FOR FABRICATING DILUTION HOLES IN CERAMIC MATRIX COMPOSITE COMBUSTOR PANELS

FIELD

The present disclosure relates to gas turbine engines and, more particularly, to heat shield panels used in the combustors of gas turbine engines.

BACKGROUND

Gas turbine engines, such as those used to power modern commercial and military aircraft, include a fan section to propel the aircraft, a compressor section to pressurize a supply of air from the fan section, a combustor section to burn a hydrocarbon fuel in the presence of the pressurized air, and a turbine section to extract energy from the resultant combustion gases in order to power the compressor and fan sections.

The combustor section typically includes a bulkhead assembly, an inner liner assembly and an outer liner assembly that, together, define a combustion chamber. Each liner assembly can be formed from one or more shells and one or more panels attached to the shells. Dilution holes are generally spaced circumferentially about the liner assemblies and serve to provide dilution air from a cooling plenum surrounding the combustor into the combustion chamber to improve emissions and to tailor the temperature profile of combustion gases at the combustor outlet to protect the turbine section from overheating.

SUMMARY

A heat shield panel for use in a combustor of a gas turbine engine is disclosed. In various embodiments, the heat shield panel includes an inner base layer, an outer base layer, and a grommet having a flange disposed between the inner base layer and the outer base layer.

In various embodiments, the grommet includes an orifice that defines a centerline and a boss portion disposed about the centerline. In various embodiments, the flange extends outward of the centerline from an outer surface of the boss portion. In various embodiments, the boss portion is disposed radially about the centerline and the flange extends radially outward of the centerline from a radially outer surface of the boss portion.

In various embodiments, the flange includes an inner face configured for contact with the inner base layer and an outer face configured for contact with the outer base layer. In various embodiments, the inner base layer includes an inner base layer aperture configured to receive an inner boss wall of the radially outer surface of the boss portion. In various embodiments, the outer base layer includes an outer base layer aperture configured to receive an outer boss wall of the radially outer surface of the boss portion.

In various embodiments, the flange defines an inner face radial extent and an inner face surface normal is substantially parallel to the centerline from proximate the radially outer surface of the boss portion to proximate the inner face radial extent. In various embodiments, the flange defines an outer face radial extent and an outer face surface normal is substantially parallel to the centerline from proximate the radially outer surface of the boss portion to proximate a transition portion and the outer face surface normal is divergent from being substantially parallel to the centerline.

A method for fabricating a heat shield panel for use in a gas turbine engine combustor is disclosed. In various embodiments, the method comprises forming an inner base layer from an inner composite matrix; forming an outer base layer from an outer composite matrix; positioning a flange of a grommet between the inner base layer and the outer base layer to form a composite matrix preform, the grommet including an orifice that defines a centerline and a boss portion disposed about the centerline, the flange extending outward of the centerline from an outer surface of the boss portion; and curing the composite matrix preform to form the heat shield panel.

In various embodiments, forming the inner base layer from the inner composite matrix includes forming an inner base layer aperture in the inner base layer configured to receive an inner boss wall of the grommet. In various embodiments, forming the outer base layer from the outer composite matrix includes forming an outer base layer aperture in the outer base layer configured to receive an outer boss wall of the grommet.

In various embodiments, the flange includes an inner face configured for contact with the inner base layer and an outer face configured for contact with the outer base layer. In various embodiments, the flange defines an inner face surface normal substantially parallel to the centerline. In various embodiments, the flange defines an outer face surface normal substantially parallel to the centerline from proximate the outer surface of the boss portion to proximate a transition portion.

In various embodiments, the method further comprises positioning the inner base layer against an inner base layer mold and positioning the outer base layer against an outer base layer mold to form a mold cavity. In various embodiments, curing the composite matrix preform to form the heat shield panel comprises chemical vapor infiltration.

In various embodiments, positioning the flange of the grommet between the inner base layer and the outer base layer to form the composite matrix preform further includes forming the grommet from a grommet composite matrix. In various embodiments, at least one of the inner composite matrix, the outer composite matrix and the grommet composite matrix are constructed of a ceramic composite material.

A gas turbine engine is disclosed. In various embodiments, the gas turbine engine includes a combustor; and a heat shield panel for use in the combustor, the heat shield panel comprising: an inner base layer, an outer base layer, and a grommet having a flange disposed between the inner base layer and the outer base layer.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1A:
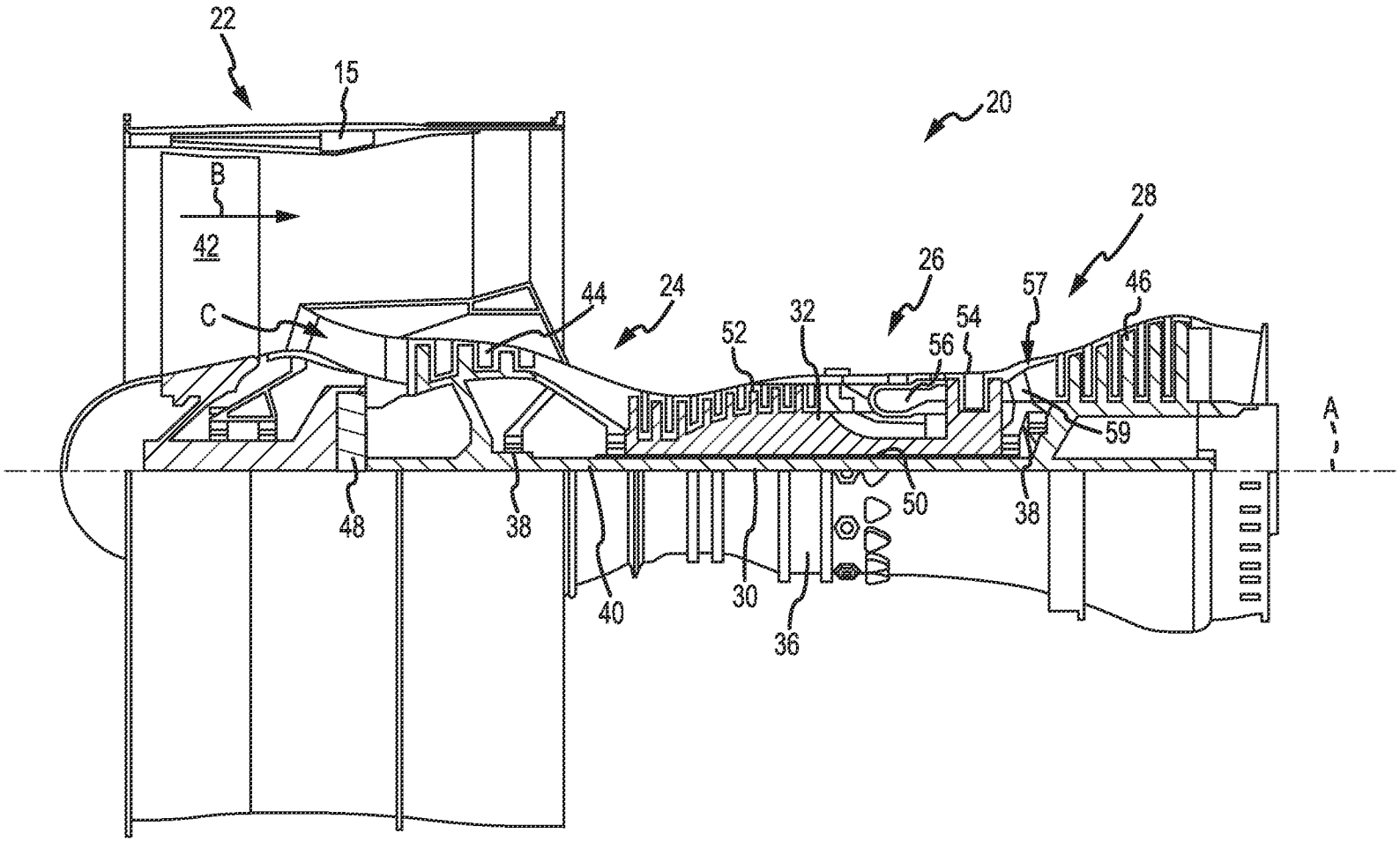
FIG. 1A is a cross sectional schematic view of a gas turbine engine, in accordance with various embodiments.

Referring now to the drawings, FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, while the compressor section 24 drives air along a primary or core flow path C for compression and communication into the combustor section 26 and then expansion through the turbine section 28. Although depicted as a two-spool turbofan gas turbine engine in the disclosed non-limiting embodiment, it will be understood that the concepts described herein are not limited to use with two-spool turbofans, as the teachings may be applied to other types of turbine engines, including three-spool architectures.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a fan drive gear system 48 configured to drive the fan 42 at a lower speed than the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with longitudinal axes of the inner shaft 40 and the outer shaft 50.

The air in the core flow path C is compressed by the low pressure compressor 44 and then the high pressure compressor 52, mixed and burned with fuel in the combustor 56, and then expanded over the high pressure turbine 54 and low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Figure 1B:
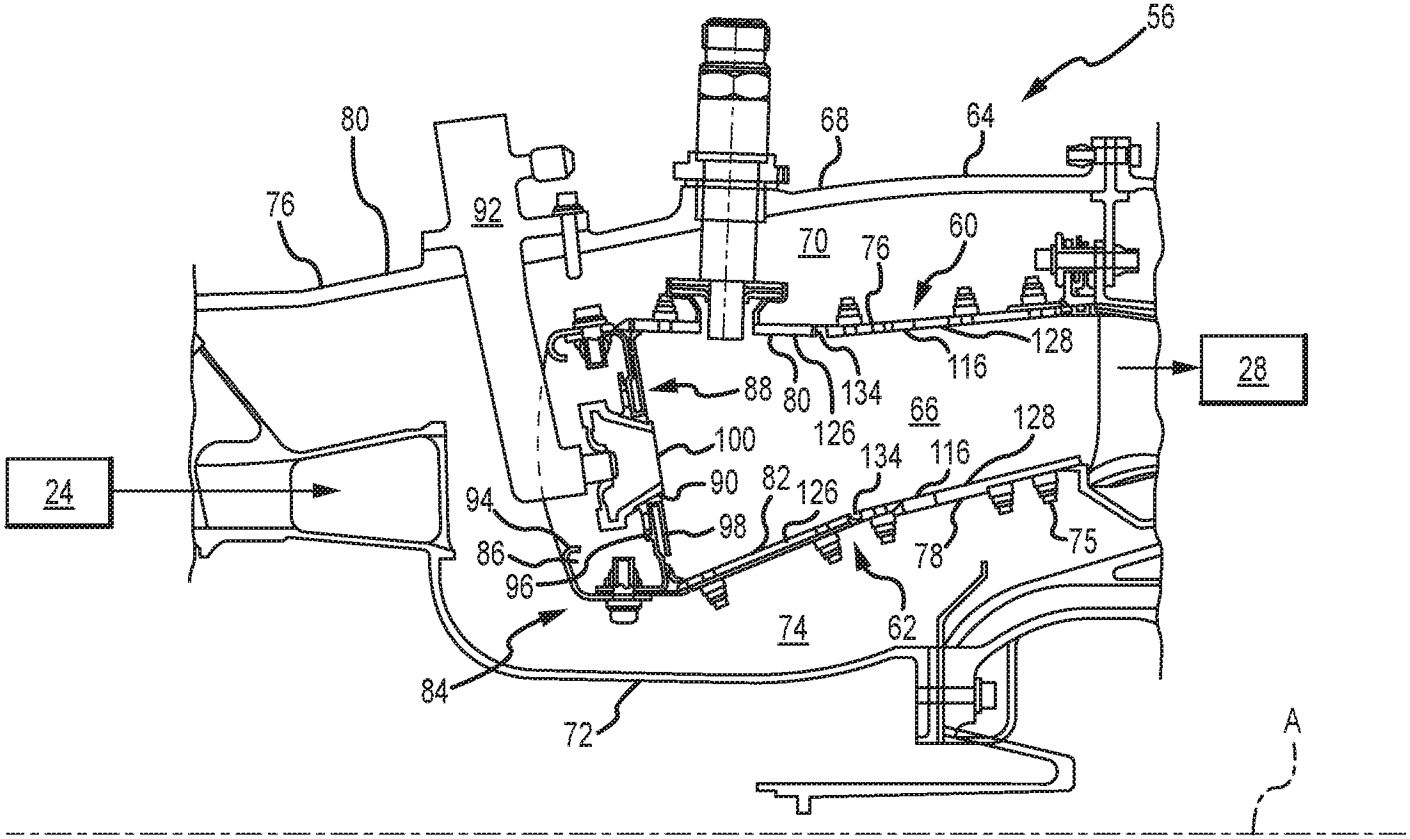
FIG. 1B is a cross sectional schematic view of a combustor section of a gas turbine engine, in accordance with various embodiments.

Referring to FIG. 1B, the combustor 56 may generally include an outer liner assembly 60, an inner liner assembly 62 and a diffuser case module 64 that surrounds the outer liner assembly 60 and the inner liner assembly 62. A combustion chamber 66, positioned within the combustor 56, has a generally annular configuration, defined by and comprising the outer liner assembly 60, the inner liner assembly 62 and a bulkhead liner assembly 88. The outer liner assembly 60 and the inner liner assembly 62 are generally conical and radially spaced apart, with the bulkhead liner assembly 88 positioned generally at a forward end of the combustion chamber 66. The outer liner assembly 60 is spaced radially inward from an outer diffuser case 68 of the diffuser case module 64 to define an outer annular plenum 70. The inner liner assembly 62 is spaced radially outward from an inner diffuser case 72 of the diffuser case module 64 to define, in-part, an inner annular plenum 74. Although a particular combustor is illustrated, it should be understood that other combustor types with various combustor liner arrangements will also benefit from this disclosure.

The combustion chamber 66 contains the combustion products that flow axially toward the turbine section 28. The outer liner assembly 60 includes an outer support shell 76 and the inner liner assembly 62 includes an inner support shell 78. The outer support shell 76 supports one or more outer panels 80 and the inner support shell 78 supports one or more inner panels 82. Each of the outer panels 80 and the inner panels 82 may be formed of a plurality of floating panels that are generally rectilinear and manufactured from, for example, a ceramic matrix composite (CMC) material or a nickel based super alloy that may be coated with a ceramic or other temperature resistant material, and are arranged to form a panel configuration mounted to the respective outer support shell 76 and inner support shell 78. In various embodiments, the combination of the outer support shell 76 and the outer panels 80 is referred to an outer heat shield or outer heat shield liner, while the combination of the inner support shell 78 and the inner panels 82 is referred to as an inner heat shield or inner heat shield liner. In various embodiments, the panels are secured to the shells via one or more attachment mechanisms 75, which may each comprise a threaded stud and nut assembly.

The combustor 56 further includes a forward assembly 84 that receives compressed airflow from the compressor section 24 located immediately upstream. The forward assembly 84 generally includes an annular hood 86, the bulkhead liner assembly 88, and a plurality of swirlers 90 (one shown). Each of the swirlers 90 is aligned with a respective one of a plurality of fuel nozzles 92 (one shown) and a respective one of a plurality of hood ports 94 (one shown) to project through the bulkhead liner assembly 88; generally, the pluralities of swirlers 90, fuel nozzles 92 and hood ports 94 are circumferentially distributed about the annular hood 86 and the bulkhead liner assembly 88. The bulkhead liner assembly 88 includes a bulkhead support shell 96 secured to the outer liner assembly 60 and to the inner liner assembly 62 and a plurality of bulkhead panels 98 secured to the bulkhead support shell 96; generally, the bulkhead panels 98 are circumferentially distributed about the bulkhead liner assembly 88. The bulkhead support shell 96 is generally annular and the plurality of bulkhead panels 98 is segmented, typically one panel to each of the fuel nozzles 92 and swirlers 90. The annular hood 86 extends radially between, and is secured to, the forward-most ends of the outer liner assembly 60 and the inner liner assembly 62. Each of the hood ports 94 receives a respective one of the plurality of fuel nozzles 92 and facilitates the direction of compressed air into the forward end of the combustion chamber 66 through a respective one of a plurality of swirler openings 100. Each of the fuel nozzles 92 may be secured to the diffuser case module 64 and project through a respective one of the hood ports 94 and into a respective one of the swirlers 90.

The forward assembly 84 introduces core compressed air into the forward section of the combustion chamber 66 while the remainder of the compressed air enters the outer annular plenum 70 and the inner annular plenum 74. The plurality of fuel nozzles 92 and adjacent structure generate a blended fuel-air mixture that supports stable combustion in the combustion chamber 66. Air in the outer annular plenum 70 and the inner annular plenum is also introduced into the combustion chamber 66 via a plurality of orifices 116, which may include dilution holes or air feed holes of various dimension. The outer support shell 76 may also include a plurality of impingement holes (discussed further below) that introduce cooling air from the outer annular plenum 70 into a space between the outer support shell 76 and a cool side of the outer panels 80. The cooling air is then communicated through a plurality of effusion holes in the outer panels 80 to form a cooling air film across a hot side of the outer panels 80 to thermally protect the outer panels 80 from hot combustion gases. Similarly, the inner support shell 78 may include a plurality of impingement holes that introduce cooling air from the inner annular plenum 74 into a space between the inner support shell 78 and a cool side of the inner panels 82. The cooling air is then communicated through a plurality of effusion holes in the inner panels 82 to form a cooling air film across a hot side of the inner panels 82 to thermally protect the inner panels 82 from hot combustion gases.

Figure 1C:
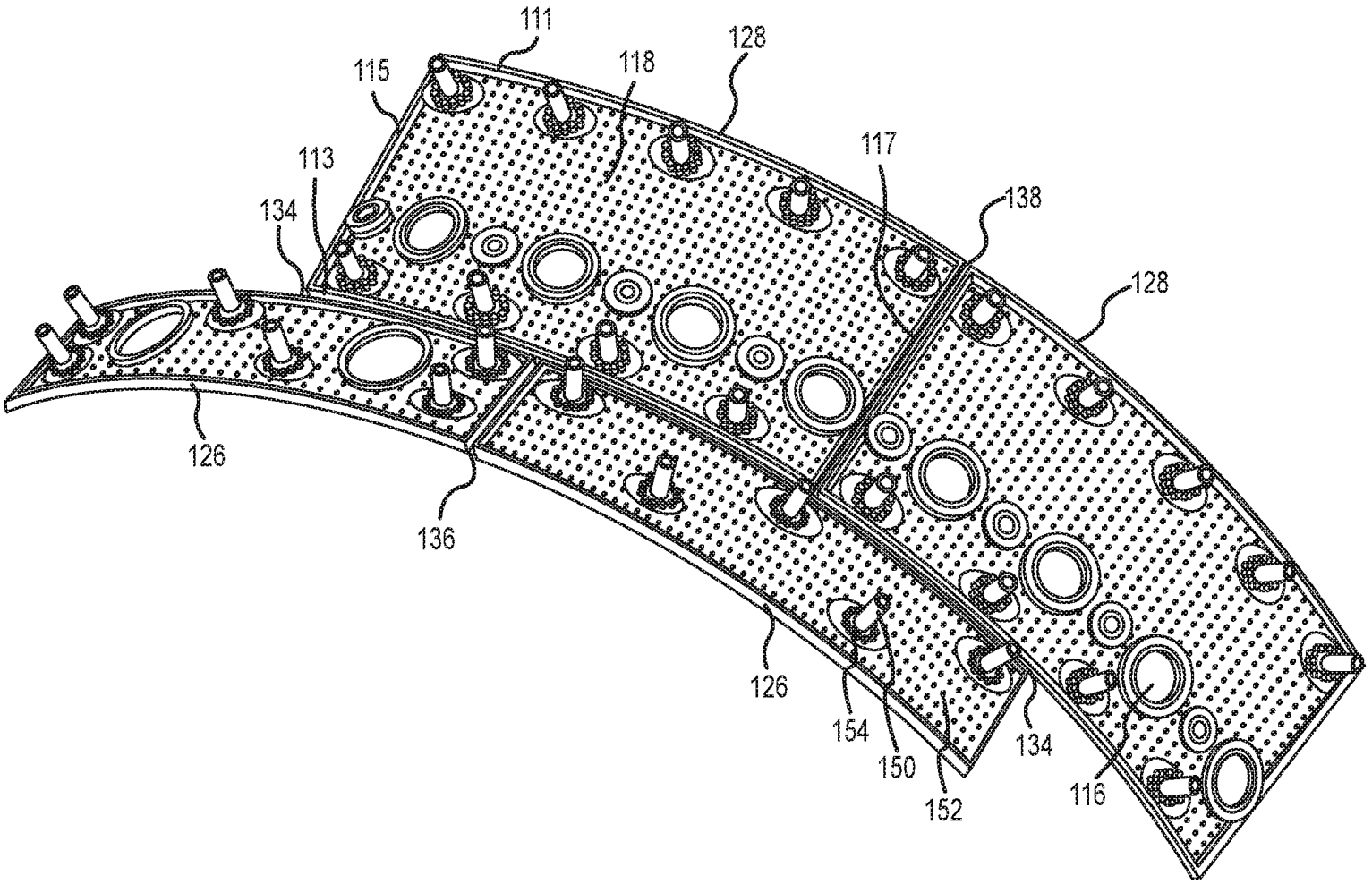
FIG. 1C is a perspective schematic view of a heat shield panel arrangement of a combustor, viewing from the cold side, according to various embodiments.

Turning now to FIG. 1C (with continued reference to FIG. 1B), an illustration of a configuration of circumferentially adjacent first panels 126 and circumferentially adjacent second panels 128 installed within the combustor 56 is shown. In various embodiments, each of the circumferentially adjacent first panels 126 and the circumferentially adjacent second panels 128 includes a first axial rail member 115, a second axial rail member 117, a first circumferential rail member 113 and a second circumferential rail member 111 that are configured to extend about an outer periphery or perimeter of a base 118. In various embodiments, the circumferentially adjacent first panels 126 are installed to extend circumferentially about the combustion chamber 66 and form a first axially extending gap 136 between the adjacent axial rail members of the circumferentially adjacent first panels 126. Similarly, the circumferentially adjacent second panels 128 are installed to extend circumferentially about the combustion chamber 66 and form a second axially extending gap 138 between the adjacent axial rail members of the circumferentially adjacent second panels 128. A first circumferentially extending gap 134 is also formed between the adjacent circumferential rail members of the circumferentially adjacent first panels 126 and the circumferentially adjacent second panels 128 when positioned axially adjacent one another. Similar axially extending and circumferentially extending gaps may be formed between similar panels positioned throughout the combustion chamber 66. The first circumferentially extending gap 134, the first axially extending gap 136 and the second axially extending gap 138 accommodate movement or thermal expansion of the circumferentially adjacent first panels 126 and the circumferentially adjacent second panels 128. Also shown in FIG. 1C is a plurality of orifices 116, which may include dilution holes of various dimension. In various embodiments, a plurality of effusion holes 152 and a shield attachment mechanism, which may include a stud 150 and a plurality of spacer pins 154, may also be incorporated into the various panels.

Figure 2A:
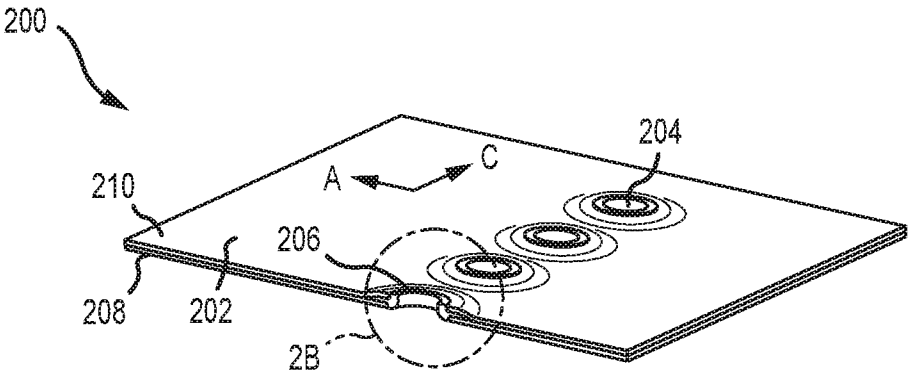
FIGS. 2A, 2B and 2C are perspective schematic views of a heat shield panel having a grommet forming a dilution hole, in accordance with various embodiments.

Referring now to FIG. 2A, an interior section of a heat shield panel 200 (or combustor panel segment) is illustrated, according to various embodiments, with reference to a circumferential (C) and an axial (A) coordinate system. The heat shield panel 200 includes a base 202 and one or more dilution holes 204 extending through the base 202. In various embodiments, the base 202 may be configured as a generally curved (e.g., arcuate) plate, that may be either convex or concave, depending on whether the panel is part of an outer liner assembly or an inner liner assembly, respectively. The heat shield panel 200 or, more particularly, the base 202 of the heat shield panel 200, includes a hot side surface 208 that forms the inner boundary of a combustion chamber, such as, for example, the combustion chamber 66 described above with reference to FIG. 1B. Opposite the hot side surface 208 is a cold side surface 210 that, in various embodiments, faces toward an outer or an inner support shell, such as, for example, the outer support shell 76 or the inner support shell 78, described above with reference to FIG. 1B. In various embodiments, the heat shield panel 200 includes axial or circumferential rail members, such as, for example, one or more of the first axial rail member 111, the second axial rail member 113, the first circumferential rail member 115 and the second circumferential rail member 117 described above with reference to FIG. 1C. In various embodiments, the base 202 may further include a plurality of effusion holes, such as, for example, the plurality of effusion holes 152 described above with reference to FIG. 1C.

Figure 2B:
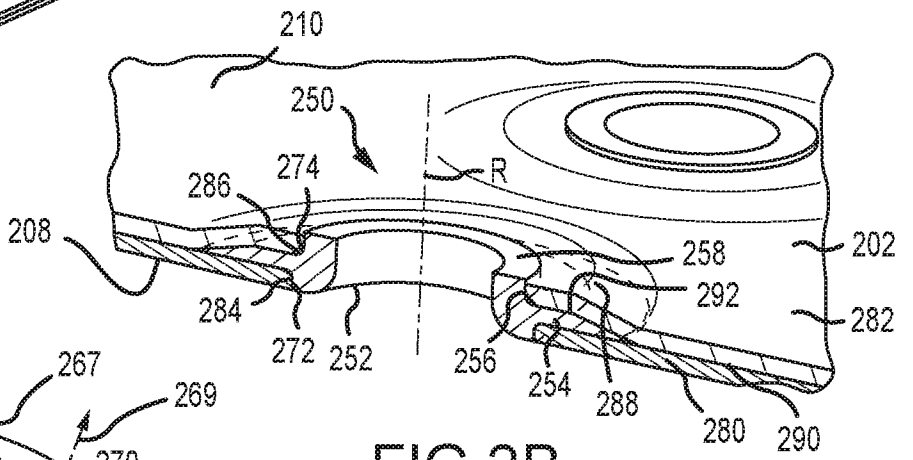
Figure 2C:
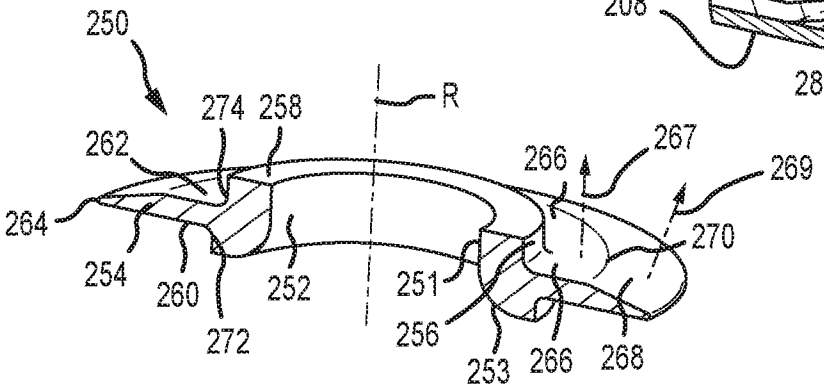

Referring now to FIGS. 2B and 2C, a grommet 250 is shown extending through the base 202 of the heat shield panel 200 and providing a dilution hole 206, such as, for example, one of the plurality of orifices 116 described above with reference to FIG. 1C or one of the plurality of dilution holes 204 referred to above with reference to FIG. 2A. In various embodiments, the grommet 250 includes an inner surface 252 that may be asymmetrically continuous (e.g., having a cylindrical portion 251 and a diffusing portion 253) or cylindrical in shape about a radial centerline R, which extends through the dilution hole 206 defined by the inner surface 252 of the grommet 250. In various embodiments, the radial centerline R is oriented substantially normal to both the hot side surface 208 and the cold side surface 210 of the base 202 and may intersect an engine central longitudinal axis, such as, for example, the engine central longitudinal axis A described above with reference to FIGS. 1A and 1B.

A flange 254 extends radially outward from a radially outer surface 256 of a boss portion 258 of the grommet 250 with respect to the radial centerline R. The flange 254 includes an inner face 260 and an outer face 262. In various embodiments, one or both of the inner face 260 and the outer face 262 taper from face portions having surface normals that are substantially parallel to the radial centerline R to a radially outermost portion 264 (e.g., an inner face radial extent or an outer face radial extent) of the flange 254. For example, as illustrated in FIG. 2C, the outer face 262 includes a first outer face portion 266 with a first surface normal 267 that is substantially parallel to the radial centerline R and a second outer face portion 268 with a second surface normal 269 that points away or is divergent from the radial centerline R. In various embodiments, the respective surface normals of the first outer face portion 266 and the second outer face portion 268 transition from substantially parallel to nonparallel (or diverging) directions with respect to the radial centerline R at a transition portion 270 that extends circumferentially about the radial centerline R at constant radius, though non-circumferential geometries, such as, for example, rectangular or elliptical, are contemplated as well. In various embodiments, the inner face 260 intersects with the boss portion 258 to form an inner boss wall 272 (i.e., a wall below the flange 254 and facing the inner base layer 280 described below with reference to FIG. 2B) and the outer face 262 intersects with the boss portion 258 to form an outer boss wall 274 (i.e., a wall above the flange 254 and facing the outer base layer 282 described below with reference to FIG. 2B). In various embodiments, the grommet 250 is a monolithic structure, constructed, for example, of a ceramic matrix composite material.

Referring to FIG. 2B, the flange 254 of the grommet 250, in various embodiments, is sandwiched between an inner base layer 280 and an outer base layer 282. In various embodiments, the inner base layer 280 forms the hot side surface 208 of the base 202 and is substantially flat or arcuate and continuous (e.g., smooth) throughout its circumferential and axial extent, excepting the region where the inner base layer 280 intersects with the inner boss wall 272 of the grommet 250. In this region, an inner base layer aperture 284 is positioned through the inner base layer 280 and, in various embodiments, is configured to surround the geometry of the inner boss wall 272 (e.g., takes the form of a thin circular cylinder of constant radius) such that the inner base layer aperture 284 may be received, placed about or placed proximate to the inner boss wall 272. Similarly, the outer base layer 282 forms the cold side surface 210 of the base 202 and is substantially flat or arcuate and continuous (e.g., smooth) throughout its circumferential and axial extent, excepting the region where the outer base layer 282 intersects with the outer boss wall 274 of the grommet 250. In this region, an outer base layer aperture 286 is positioned through the outer base layer 282 and, in various embodiments, is configured to surround the geometry of the outer boss wall 274 (e.g., takes the form of a thin circular cylinder of constant radius) such that the outer base layer aperture 286 may be received by, place about or placed proximate to the outer boss wall 274. Further, in this region, the outer base layer 282 may include an outer base layer transition portion 288, where the outer base layer 282 transitions from a common contact surface 290, defined by a common surface of contact between the inner base layer 280 and the outer base layer 282, to a flange contact surface 292, where the outer base layer 282 departs from its otherwise substantially flat or arcuate shape to accommodate the thickness of the flange 254.

Figure 3A:
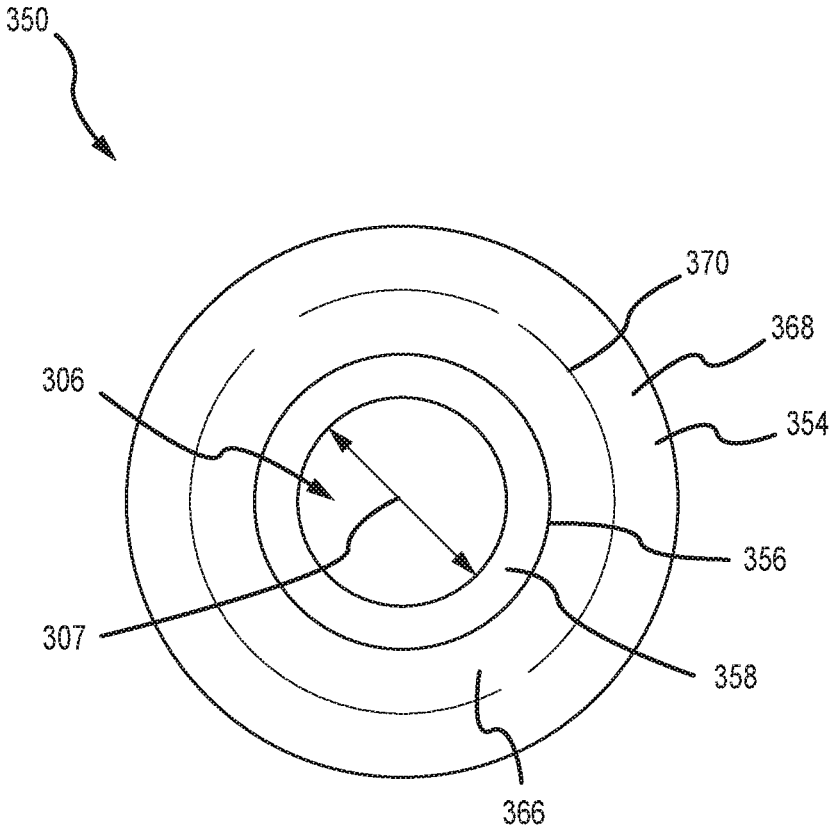
FIGS. 3A and 3B are overhead and cross-sectional schematic views of a grommet, in accordance with various embodiments.
Figure 3B:
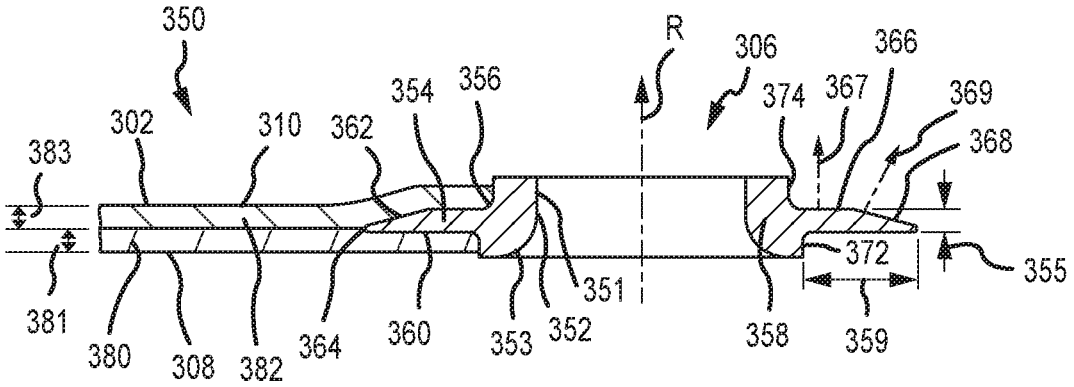

Referring now to FIGS. 3A and 3B a grommet 350 is shown in overhead and side schematic views, in accordance with various embodiments. In various embodiments, the grommet 350 may be configured to extend through a base 302 of a heat shield panel and provide a dilution hole, such as, for example, the base 202 of the heat shield panel 200 described above with reference to FIGS. 2A, 2B and 2C. In various embodiments, the grommet 350 includes an inner surface 352 that may be asymmetrically continuous (e.g., having a cylindrical portion 351 and a diffusing portion 353) or cylindrical in shape about a radial centerline R, which extends through a dilution hole 306 defined by the inner surface 352 of the grommet 350. In various embodiments, the radial centerline R is oriented substantially normal to both a hot side surface 308 and a cold side surface 310 of the base 302 and may intersect an engine central longitudinal axis, such as, for example, the engine central longitudinal axis A described above with reference to FIGS. 1A and 1B.

In various embodiments, a flange 354 extends radially outward from a radially outer surface 356 of a boss portion 358 of the grommet 350 with respect to the radial centerline R. The flange 354 includes an inner face 360 and an outer face 362. In various embodiments, one or both of the inner face 360 and the outer face 362 taper from face portions having surface normals that are substantially parallel to the radial centerline R to a radially outermost portion 364 (e.g., an inner face radial extent or an outer face radial extent) of the flange 354. For example, as illustrated in FIG. 3B, the outer face 362 includes a first outer face portion 366 with a first surface normal 367 that is substantially parallel to the radial centerline R and a second outer face portion 368 with a second surface normal 369 that points away or is divergent from the radial centerline R. In various embodiments, the respective surface normals of the first outer face portion 366 and the second outer face portion 368 transition from substantially parallel to nonparallel (or diverging) directions with respect to the radial centerline R at a transition portion 370 that extends circumferentially about the radial centerline R at constant radius, though non-circumferential geometries, such as, for example, rectangular or elliptical, are contemplated as well. In various embodiments, the inner face 360 intersects with the boss portion 358 to form an inner boss wall 372 and the outer face 362 intersects with the boss portion 358 to form an outer boss wall 374.

In various embodiments, the flange 354 may define a flange thickness 355 that is of the order of fifty one-thousandths inch ($^{50}/_{1000}$ inch)(≈1.27 mm). In various embodiments, the flange 354 of the grommet 350 may define a flange radial distance 359 that is from about three (3) times to about five (5) times the flange thickness 355. In various embodiments, the flange radial distance 359 extends in a radial direction from the radially outer surface 356 of the boss portion 358 to the radially outermost portion 364 of the flange 354. In various embodiments, an inner base layer 380 and an outer base layer 382, such as, for example, the inner base layer 280 and the outer base layer 282, described above with reference to FIG. 2B, define an inner base layer thickness 381 and an outer base layer thickness 383. In various embodiments, one or both of the inner base layer thickness 381 and the outer base layer thickness 383 is of the order of fifty one-thousandths inch ($^{50}/_{1000}$ inch)(≈1.27 mm). In various embodiments, the inner base layer 380 may comprise from about two (2) to about ten (10) plies of ceramic matrix material and, in various embodiments, the inner base layer 380 may comprise about four (4) plies of ceramic matrix material, with each plie of ceramic matrix material having a thickness of the order of twelve one-thousandths inch ($^{12}/_{1000}$ inch)(≈0.305 mm). Similarly, in various embodiments, the outer base layer 382 may comprise from about two (2) to about ten (10) plies of ceramic matrix material and, in various embodiments, the outer base layer 382 may comprise about four (4) plies of ceramic matrix material, with each plie of ceramic matrix material having a thickness of the order of twelve one-thousandths inch ($^{12}/_{1000}$ inch)(≈0.305 mm). In various embodiments, the dilution hole 306 may define a dilution hole diameter 307 that is of the order of two-tenths inch (0.2 inch)(≈5.1 mm) to about one inch (1.0 inch)(≈25.4 mm).

Figure 4:
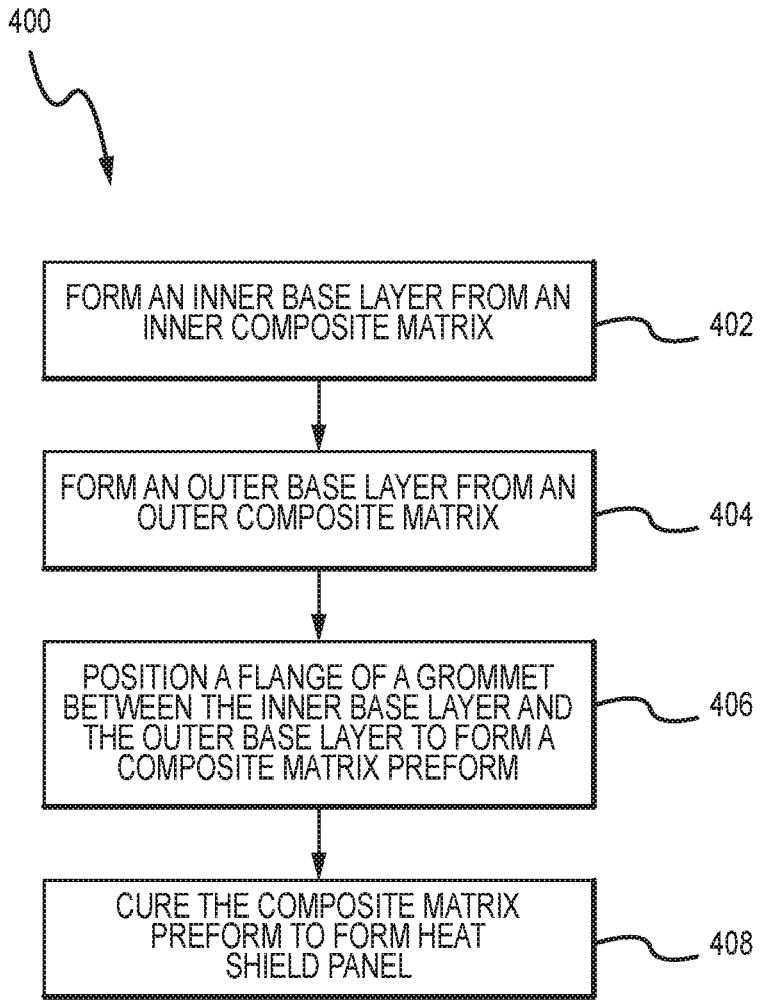
FIG. 4 is a flowchart illustrating various steps used to fabricate a heat shield panel, in accordance with various embodiments.

Referring now to FIG. 4, a method 400 for fabricating a heat shield panel for use in a gas turbine engine combustor is described, in accordance with various embodiments. The method includes the steps of forming an inner base layer from an inner composite matrix 402 and forming an outer base layer from an outer composite matrix 404. In various embodiments, the inner composite matrix and the outer composite matrix comprise a ceramic composite material. In various embodiments, the method further includes positioning a flange of a grommet between the inner base layer and the outer base layer to form a composite matrix preform 406. In various embodiments, the grommet includes an orifice that defines a centerline and a boss portion disposed about the centerline, the flange extending outward of the centerline from an outer surface of the boss portion. In various embodiments, the method also includes curing the composite matrix preform to form the heat shield panel 408.

Similar to the foregoing, in various embodiments, an inner base layer may be formed from an inner composite matrix. A flange of a grommet may then be positioned adjacent the inner base layer or through an aperture positioned within the inner base layer. An outer base layer may then be formed from an outer composite matrix and positioned adjacent or through an aperture positioned within the outer base layer. Similarly, in various embodiments, an outer base layer may be formed from an outer composite matrix. A flange of a grommet may then be positioned adjacent the outer base layer or through an aperture positioned within the outer base layer. An inner base layer may then be formed from an inner composite matrix and positioned adjacent or through an aperture positioned within the inner base layer.

In various embodiments, the step of forming the inner base layer from the inner composite matrix includes forming an inner base layer aperture in the inner base layer that is configured to receive or be placed against, about or proximate an inner boss wall of the grommet. The step of forming the outer base layer from the outer composite matrix may similarly include forming an outer base layer aperture in the outer base layer configured to receive or be placed against, about or proximate an outer boss wall of the grommet.

In various embodiments, the method comprises positioning the inner base layer against an inner base layer mold and positioning the outer base layer against an outer base layer mold to form a mold cavity. In various embodiments, the composite matrix preform is cured within the mold cavity. In various embodiments, the process of curing the composite matrix preform is carried out using chemical vapor infiltration or melt infiltration into the mold cavity. In various embodiments, the grommet composite matrix is constructed of a ceramic composite material. In various embodiments, each of the inner composite matrix, the outer composite matrix and the grommet composite matrix comprise a ceramic composite material.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A heat shield panel for use in a combustor of a gas turbine engine, comprising:

an inner base layer;

an outer base layer; and a grommet having a flange disposed between the inner base layer and the outer base layer, wherein the grommet includes an orifice that defines a centerline and a boss portion disposed about the centerline, wherein the flange extends outward of the centerline from an outer surface of the boss portion and wherein the flange defines an outer face radial extent, wherein a first outer face surface normal is parallel to the centerline along a first outer face portion, from the outer surface of the boss portion to a transition portion, and a second outer face surface normal is divergent from being parallel to the centerline along a second outer face portion, from the transition portion to the outer face radial extent.

2. The heat shield panel of claim 1, wherein the boss portion is disposed radially about the centerline and wherein the flange extends radially outward of the centerline from a radially outer surface of the boss portion.

3. The heat shield panel of claim 1, wherein the flange includes an inner face configured for contact with the inner base layer and the outer face is configured for contact with the outer base layer.

4. The heat shield panel of claim 3, wherein the inner base layer includes an inner base layer aperture configured to receive an inner boss wall of the boss portion.

5. The heat shield panel of claim 4, wherein the outer base layer includes an outer base layer aperture configured to receive an outer boss wall of the boss portion.

6. The heat shield panel of claim 5, wherein the flange defines an inner face radial extent and wherein an inner face surface normal is parallel to the centerline from the radially outer surface of the boss portion to the inner face radial extent.

7. A method for fabricating a heat shield panel for use in a gas turbine engine combustor, comprising:

forming an inner base layer from an inner composite matrix;

forming an outer base layer from an outer composite matrix;

positioning a flange of a grommet between the inner base layer and the outer base layer to form a composite matrix preform, the grommet including an orifice that defines a centerline and a boss portion disposed about the centerline, the flange extending outward of the centerline from an outer surface of the boss portion, wherein the flange defines an outer face radial extent, wherein a first outer face surface normal is parallel to the centerline along a first outer face portion, from the outer surface of the boss portion to a transition portion, and a second outer face surface normal is divergent from being parallel to the centerline along a second outer face portion, from the transition portion to the outer face radial extent; and curing the composite matrix preform to form the heat shield panel.

8. The method of claim 7, wherein forming the inner base layer from the inner composite matrix includes forming an inner base layer aperture in the inner base layer configured to receive an inner boss wall of the grommet.

9. The method of claim 8, wherein forming the outer base layer from the outer composite matrix includes forming an outer base layer aperture in the outer base layer configured to receive an outer boss wall of the grommet.

10. The method of claim 9, wherein the flange includes an inner face configured for contact with the inner base layer and the outer face is configured for contact with the outer base layer.

11. The method of claim 10, wherein the flange defines an inner face normal parallel to the centerline.

12. The method of claim 7, further comprising positioning the inner base layer against an inner base layer mold and positioning the outer base layer against an outer base layer mold to form a mold cavity.

13. The method of claim 12, wherein curing the composite matrix preform to form the heat shield panel comprises chemical vapor infiltration.

14. The method of claim 7, wherein positioning the flange of the grommet between the inner base layer and the outer base layer to form the composite matrix preform further includes forming the grommet from a grommet composite matrix.

15. The method of claim 14, wherein at least one of the inner composite matrix, the outer composite matrix and the grommet composite matrix are constructed of a ceramic composite material.

16. A gas turbine engine, comprising:

a combustor; and a heat shield panel for use in the combustor, comprising:

an inner base layer;

an outer base layer; and a grommet having a flange disposed between the inner base layer and the outer base layer, wherein the grommet includes an orifice that defines a centerline and a boss portion disposed about the centerline, wherein the flange extends outward of the centerline from an outer surface of the boss portion and wherein the flange defines an outer face radial extent, wherein a first outer face surface normal is parallel to the centerline along a first outer face portion, from the outer surface of the boss portion to a transition portion, and a second outer face surface normal is divergent from being parallel to the centerline along a second outer face portion, from the transition portion to the outer face radial extent.

* * * * *